US005502911A

United States Patent [19]

Watts et al.

[11] Patent Number: 5,502,911

[45] Date of Patent: Apr. 2, 1996

[54] VISUAL DISPLAY DEVICE FOR ANALGESIC CONTAINER

[75] Inventors: Colin F. Watts, Yardley; Bruce D. Stefanowicz, Collegeville, both of Pa.

[73] Assignee: McNeil-PPC, Inc., Milltown, N.J.

[21] Appl. No.: 213,309

[22] Filed: Mar. 14, 1994

[51] Int. Cl.[6] ..... G09F 3/08; G09F 19/00

[52] U.S. Cl. ..... 40/642; 248/311.2

[58] Field of Search ..... 220/476, 375, 220/480, 421; 215/306; 248/311.2; 434/429; 211/74, 89; 40/64, 642; 206/44.11

[56] References Cited

U.S. PATENT DOCUMENTS

| | | | |
|---|---|---|---|
| 241,921 | 5/1881 | Brooke | 215/306 |
| 721,477 | 2/1903 | Tatum | 215/306 |
| 1,294,883 | 2/1919 | Dixon et al. | 211/74 |
| 1,913,587 | 6/1933 | Edwards | 248/311.2 |
| 2,508,945 | 5/1950 | Heuer | 211/75 |
| 2,517,829 | 8/1950 | Beckovich | 248/311.2 |
| 2,547,353 | 4/1951 | Wiinikka | 220/375 |
| 2,708,062 | 5/1955 | Poyer | 211/74 |
| 3,424,421 | 1/1969 | Kalbow et al. | 211/74 |
| 4,441,638 | 4/1984 | Shimano | 248/311.2 |
| 4,805,331 | 2/1989 | Boggess et al. | 40/611 |
| 5,011,040 | 4/1991 | Kinast | 220/375 |
| 5,358,128 | 10/1994 | Belokin et al. | 211/75 |

*Primary Examiner*—David Scherbel
*Assistant Examiner*—Tony G. Soohoo
*Attorney, Agent, or Firm*—Paul A. Coletti

[57] ABSTRACT

A device for display of a container which comprises a display frame attached to the grocery store shelf. This frame extends from the edge of the shelf to which it is attached. This frame is generally rectangular in configuration. Attached to the frame are container holding means, which container holding means are capable of fixedly holding an attached container thereon. These container holding means are fixedly held against the frame. Similarly, there is a container fixedly held against the frame, generally by such means as rivets, adhesive or screws. Attached to the container is a cap, also fixedly attached, either to the frame or to the container itself. Therefore, the user is able to attempt to operate the analgesic container cap, and the display device is able to attract customers, and yet neither container or the cap is taken by a potential customer, therefore depriving other customers of use of this sample.

15 Claims, 3 Drawing Sheets

54
50
52
40
22
100

VISUAL DISPLAY DEVICE FOR ANALGESIC CONTAINER

FIELD OF THE INVENTION

Generally, this invention relates to display devices. More specifically, this invention relates to visual display devices for analgesic containers.

BACKGROUND OF THE INVENTION

It is well known in the display device field to incorporate display devices on grocery store shelves. Typically, there are placed frames on such shelves. These frames are capable of holding within them literature or free samples of a particular product, to be taken by consumers. These display devices have proven quite functional in their capability of attracting customers who desire to learn more about such products.

Heretofore, however, there has not been a device capable of demonstrating the attributes of an analgesic container. Specifically, such devices as the Easi-Open container marketed by McNeil Consumer Products, Inc. would be valuable if able to be demonstrated to customers at the supermarket. If this could be done, the customers could learn how easy to open this container is, in fact. It is appreciated that this may enhance sales of such product.

SUMMARY OF THE INVENTION

It is an object of the invention to provide a display device for displaying containers. It is also an object of the invention to cause the container to be resiliently and fixedly attached to the display device so that it can not be taken home, therefore depriving other customers of attempting to use such display device sample.

These and other objects of the invention are accomplished in a device for display of a container which comprises a display frame attached to the grocery store shelf. This frame extends from the edge of the shelf to which it is attached. This frame is generally rectangular in configuration. Attached to the frame are container holding means, which container holding means are capable of fixedly holding an attached container thereon. These container holding means are fixedly held against the frame. Similarly, there is a container fixedly held against the frame, generally by such means as rivets, adhesive or screws. Attached to the container is a cap, also fixedly attached, either to the frame or to the container itself. Therefore, the user is able to attempt to operate the analgesic container cap, and the display device is able to attract customers, and yet neither container or the cap is taken by a potential customer, therefore depriving other customers of use of this sample.

DESCRIPTION OF THE DRAWINGS

The above invention will be better understood in connection with the Detailed Description of the Invention taken with the following drawings in which.

DETAILED DESCRIPTION OF THE INVENTION

Figure 1:
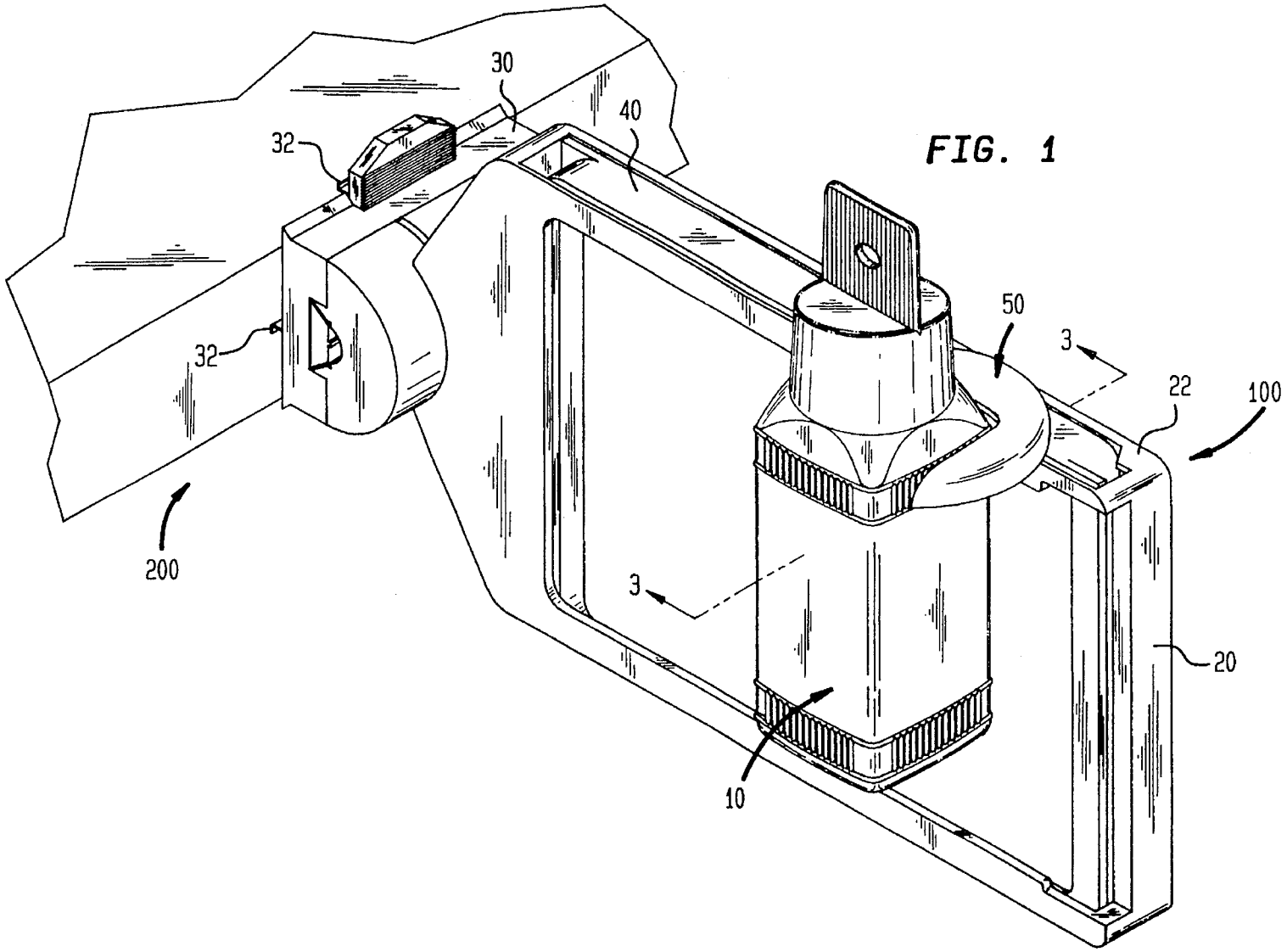
FIG. 1 is a perspective view of a display device of the present invention.
Figure 2:
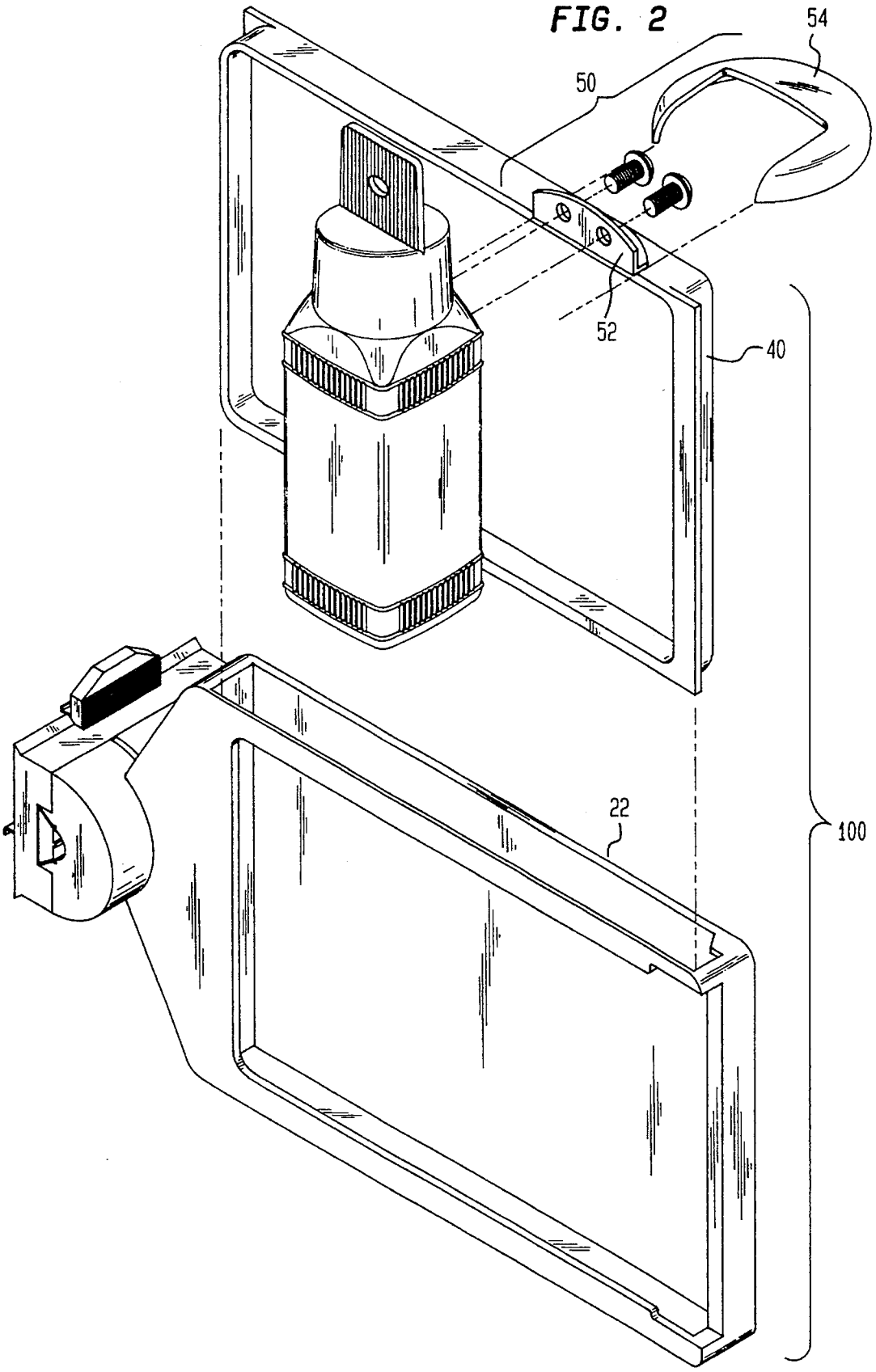
FIG. 2 is a exploded view of a display device of the present invention.
Figure 3:
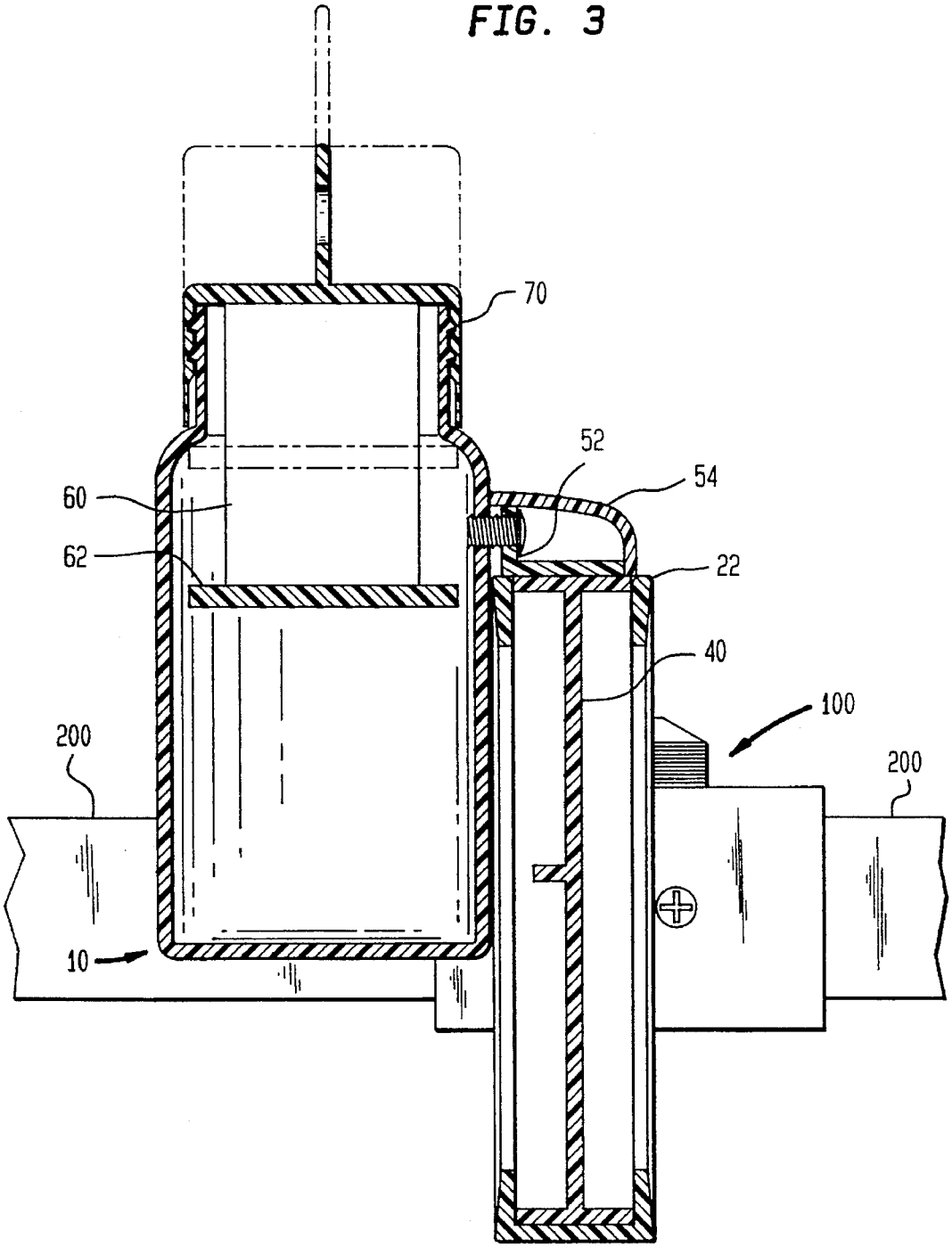
FIG. 3 is a cross-sectional view of the device taken across lines 3—3 of FIG. 2.

As can been seen from FIGS. 1–3 there is contained a display device 100 for displaying a container 10 as described by the invention herein. This device consists of a rectangular frame 20 which is attachable to a grocery store shelf 200. The rectangular frame 20 has connected to it a transversely configured attachment mechanism 30 which can be adherently or fixedly secured to a grocery store shelf. Particularly adapted for attachment to the shelf are flanges 32 which fit within flanges contained on the shelf.

Extending from the frame 20 there is a generally rectangular insert mechanism 40. This insert mechanism has attached to it a container holding mechanism 50. The insert mechanism can be locked within the frame by emplacement of the insert mechanism 40 into the rectangular opening 22 in the top of the frame. After locking in the frame, the insert mechanism abuts a flange contained on the internal portion of the frame.

All of what has previously been disclosed except for the container attachment mechanism 50 is well known in the art. Attached to the insert mechanism 40, however, is the container holding mechanism 50 which is new to this invention. This container holding mechanism is a transverse flange 52 which extends from the insert mechanism 40. The container holding mechanism 50 is capable of being adhesively attached to a container 10. This container holding mechanism may be attached by means of adhesives, screws, rivets and the like. Fitting around the flange 52 which comprises the container holding mechanism is a collar 54, which obscures the flange and makes for a better visual display means. The analgesic container 10 itself is attached to the container holding mechanism 50. Contained in the analgesic container 50 is a cap holding mechanism 60 which consists of a widened plastic device 62 which is fixedly attached to the cap 70. This wide device 62 has a width larger than the opening in the neck of the container. Thus, when the user attempts to pull the cap 70 off the container 10, the wide strip 62 contacts the container 10 and fixedly holds the cap 70 to the container holding mechanism 60.

In use, therefore, the device of the present invention holds the container thereto. The user, upon seeing the display device is able to attempt to use the cap. The cap, being fixedly attached to the container is able to be screwed and unscrewed but cannot be removed from the grocery store. Similarly, the container, because it is fixedly attached by the container holding means to the display device is similarly not able to be removed from the store. Thus, the user is able to enjoy all the benefits of the display, and yet is not able to abscond with the display container.

This invention has been particularly described in connection with a particularly preferred embodiment. It will readily understood that the invention is to be derived from the attached claims and their equivalents.

We claim:

1. In combination:

a shelf having generally parallel upper and lower surfaces connected by a generally planar edge surface disposed at right angles to said upper and lower surfaces; and a device for display of a container on said shelf comprising:

a display frame for attachment to said shelf, said frame extending at generally perpendicular angles from the edge surface of the shelf to which it is attached;

container holding means contained on said frame, said container holding means capable of fixedly holding a container thereon; and a container held fixedly against said frame by said container holding means.

2. The device of claim 1 further comprising a collar surrounding said container holding means and at least a portion of said container.

3. The device of claim 1 wherein said container holding means comprises rivets.

4. The device of claim 1 wherein said container holding means comprises adhesive.

5. The device of claim 1 wherein said container holding means comprises screws.

6. The device of claim 1 wherein said frame is generally rectangular in shape and said container holding means extends from a portion of said rectangle.

7. The device of claim 1 wherein said container holding means comprises a flange abutting said container, and a fastener attaching said flange to said container.

8. The device of claim 1 wherein said container is matable with a cap, and said cap is attached to cap holding means fixedly held within said container.

9. In combination:

a shelf having generally parallel upper and lower surfaces connected by a generally planar edge surface disposed at right angles to said upper and lower surfaces; and a device for display of a container on said shelf comprising:

a display frame for attachment to a shelf, said frame extending at generally perpendicular angles from the edge surface of the shelf to which it is attached;

container holding means contained on said frame, said container holding means capable of fixedly holding a container thereon;

a container held fixed against said frame by said container holding means; and said container is matable with a cap, and said cap is attached to cap holding means fixedly held within said container.

10. The device of claim 9 further comprising a collar surrounding said container holding means and at least a portion of said container.

11. The device of claim 9 wherein said container holding means comprises rivets.

12. The device of claim 9 wherein said container holding means comprises adhesive.

13. The device of claim 9 wherein said container holding means comprises screws.

14. The device of claim 9 wherein said frame is generally rectangular in shape and said container holding means extends from a portion of said rectangle.

15. The device of claim 9 wherein said container holding means comprises a flange abutting said container, and a fastener attaching said flange to said container.

* * * * *